US012296218B2

(12) United States Patent
Petek

(10) Patent No.: US 12,296,218 B2
(45) Date of Patent: May 13, 2025

(54) STACKABLE WEIGHT

(71) Applicant: Richard C. Petek, Medina, OH (US)

(72) Inventor: Richard C. Petek, Medina, OH (US)

( * ) Notice: Subject to any disclaimer, the term of this patent is extended or adjusted under 35 U.S.C. 154(b) by 0 days.

(21) Appl. No.: 18/604,545

(22) Filed: Mar. 14, 2024

(65) Prior Publication Data

US 2024/0216745 A1 Jul. 4, 2024

Related U.S. Application Data

(63) Continuation of application No. 17/502,367, filed on Oct. 15, 2021, now Pat. No. 11,957,949.

(60) Provisional application No. 63/104,595, filed on Oct. 23, 2020.

(51) Int. Cl.

| | |
|---|---|
| ***A63B 21/075*** | (2006.01) |
| ***A63B 21/06*** | (2006.01) |
| ***A63B 21/072*** | (2006.01) |
| *A63B 21/00* | (2006.01) |

(52) U.S. Cl.

CPC ..... *A63B 21/075* (2013.01); *A63B 21/0604* (2013.01); *A63B 21/0728* (2013.01); *A63B 21/0724* (2013.01); *A63B 21/0726* (2013.01); *A63B 21/4035* (2015.10)

(58) Field of Classification Search

CPC ..... A63B 21/0604; A63B 21/072; A63B 21/0728; A63B 21/0724; A63B 21/0726; A63B 21/075; A63B 21/4035; A63B 2210/50

See application file for complete search history.

(56) References Cited

U.S. PATENT DOCUMENTS

| | | | | |
|---|---|---|---|---|
| 5,072,933 | A | 12/1991 | Diodati | |
| 5,853,355 | A * | 12/1998 | Standish | A63B 21/0601 482/106 |
| 6,461,282 | B1 * | 10/2002 | Fenelon | A63B 21/0601 482/106 |
| 6,736,765 | B2 * | 5/2004 | Wallace | A63B 21/072 482/106 |
| 7,011,611 | B1 * | 3/2006 | Ripley | A63B 21/0728 482/107 |
| 7,981,013 | B2 | 7/2011 | Krull | |
| 8,454,485 | B1 * | 6/2013 | Hodes | A63B 21/072 482/141 |

(Continued)

OTHER PUBLICATIONS

Powerblock, announced 2016[online], [site visited Feb. 15, 2022]. Available on internet, URL:https://www.amazon.com/POWERBLOCK-Adjustable-Kettlebell-Black-35/dp/B004WYV9AU/ref (Year: 2016).

(Continued)

*Primary Examiner* — Joshua Lee
(74) *Attorney, Agent, or Firm* — Tucker Ellis LLP

(57) ABSTRACT

Provided is a stackable weight that can be stacked alongside other stackable weights to achieve a desired weight on a weight bar. The stackable weight includes a handle to carry the stackable weight, an opening to attach the stackable weight to a weight bar, and at least one feature to engage at least one feature of a second stackable weight. The at least one feature of the stackable weight reduces movement of the stackable weight in relation to any number of other stackable weights when attached on a weight bar. The stackable weights may vary in size and weight to allow a user to achieve a desired weight of the weight bar.

20 Claims, 11 Drawing Sheets

(56) References Cited

U.S. PATENT DOCUMENTS

| | | | | |
|---|---|---|---|---|
| 8,992,396 | B2 * | 3/2015 | Wang | A63B 21/0726 482/106 |
| 9,011,300 | B2 * | 4/2015 | Hodes | A63B 21/072 482/141 |
| 9,138,610 | B2 * | 9/2015 | Lovegrove | A63B 21/0004 |
| D796,592 | S | 9/2017 | Towley | |
| D797,869 | S | 9/2017 | Baudhuin et al. | |
| D896,900 | S | 9/2020 | Wang | |
| 2001/0049324 | A1 * | 12/2001 | Wallace | A63B 21/0783 482/106 |
| 2002/0077225 | A1 | 6/2002 | Selsam | |
| 2004/0072662 | A1 * | 4/2004 | Landfair | A63B 21/0605 482/106 |
| 2004/0077466 | A1 * | 4/2004 | Wallace | A63B 21/0783 482/93 |
| 2007/0142188 | A1 * | 6/2007 | Lien | A63B 21/0728 482/93 |
| 2011/0275494 | A1 | 11/2011 | Radi et al. | |
| 2011/0306475 | A1 | 12/2011 | Caswell et al. | |
| 2011/0319233 | A1 | 12/2011 | Ross et al. | |
| 2013/0040789 | A1 | 2/2013 | Kessler | |
| 2013/0137555 | A1 * | 5/2013 | Hodes | A63B 21/075 482/106 |
| 2013/0184129 | A1 * | 7/2013 | Lovegrove | A63B 21/0728 482/107 |
| 2015/0196792 | A1 | 7/2015 | Towley et al. | |
| 2016/0030796 | A1 * | 2/2016 | Lovegrove | A63B 23/12 482/93 |
| 2016/0303420 | A1 | 10/2016 | Silagy et al. | |
| 2017/0225025 | A1 | 8/2017 | Towley | |
| 2018/0117387 | A1 | 5/2018 | Wang | |
| 2019/0168060 | A1 | 6/2019 | Laurence | |
| 2019/0388723 | A1 * | 12/2019 | Nalley | A63B 21/4035 |

OTHER PUBLICATIONS

"ATX Delta Swing Olympic Weights," The Gym Revolution [online], [retrieved on Apr. 20, 2021], Retrieved from the internet: <URL: https://www.thegymrevolution.co.uk/index.php/brands/atx-strength/atx-delta-swing-olympic-weights.html.

International Search Report and Written Opinion of corresponding PCT Application No. PCT/US2021/055161, dated Feb. 14, 2022, 10 pages.

* cited by examiner

STACKABLE WEIGHT

RELATED APPLICATIONS

This application is continuation of U.S. patent application Ser. No. 17/502,367, filed Oct. 15, 2021, which claims the benefit of U.S. Provisional Application No. 63/104,595 filed Oct. 23, 2020, which are hereby incorporated by reference.

FIELD OF INVENTION

The present invention relates generally to a weight, and more particularly to a stackable weight for use with exercising equipment.

BACKGROUND

Weight bars, often referred to as barbells or dumbbells, may be used for weight lifting, body building, or strength training. Weight bars are typically long bars in which individual weights are attached to at both ends of the weight bar. Generally, the individual weights vary in size and weight to allow a weightlifter to increase or decrease the total weight of the weight bar by adding or subtracting the individual weights. The individual weights are usually in the form of round plates with openings at the center to allow the weights to be attached to the individual ends of the weight bar. A device, such as a collar, can be used at each end of the weight bar to prevent the individual weights from sliding off of the weight bar while in use.

There are various different types of weight bars that differ in shape and size. Barbells typically refer to longer weight bars that are used for exercises such as the benching press, the military press, deadlifting, squatting, etc. Dumbbells often refer to shorter weight bars that used for exercises such as bicep curls, hammer curls, etc.

SUMMARY OF INVENTION

The present application provides a stackable weight to be used with weight bars, such as barbells, dumbbells, leg sleds, etc. The stackable weight includes a handle and various features that allow a user to stack multiple weights against one another. The stackable weights can vary in size and weight to allow a user to combine any number of stackable weights to achieve a desired total weight of the weight bar.

According to an aspect, a stackable weight comprises a body having a first end and a second end opposite the first end, a handle attached to the first end of the body, wherein the handle is configured to allow a user's hand to grasp the handle, an opening in the body, wherein the opening extends from a front surface of the body to a rear surface of the body, and one or more projections configured to engage one or more corresponding recesses of a second stackable weight, the one or more projections and the one or more recesses configured to orient the first end of the stackable weight to a corresponding first end of the second stackable weight and configured to prevent rotation of the stackable weight relative to the second stackable weight.

In an aspect, the front surface of the stackable weight engages with a rear surface of the second stackable weight, and the handle of the stackable weight is oriented in the same direction as a handle of the second stackable weight.

In an aspect, the one or more projections of the stackable weight engage the one or more recesses of the second stackable weight when the one or more projections of the stackable weight and the one or more recesses of the second stackable weight are aligned with one another.

In an aspect, the stackable weight comprises a plurality of projections on the front surface of the body, the plurality of projections configured to engage a corresponding one of a plurality of recesses on the rear surface of the second stackable weight.

In an aspect, the stackable weight comprises a plurality of recesses on the front surface of the body, the plurality of recesses configured to engage a corresponding one of a plurality of projections on a rear surface of the second stackable weight.

In an aspect, a center of gravity of the stackable weight is located in a position relative the second end of the body to orient the second end of the body towards a ground surface.

In an aspect, the second end of the body is substantially flat such that the stackable weight does not roll when placed on a surface.

In an aspect, the stackable weight has a color that represents the weight of the stackable weight for identification by the user.

In an aspect, the opening is configured to facilitate attachment of the stackable weight to a weight bar.

According to another aspect, a weight lifting system comprises at least two stackable weights configured to attach to a weight bar, the at least two stackable weights comprising a body having a first end and a second end, a handle attached to the first end of the body, wherein the handle is configured to allow a user's hand to grasp the handle, an opening in the body, wherein the opening extends from a front surface of the body to a rear surface of the body, and one or more projections configured to engage one or more recesses of a second stackable weight, the one or more projections and one or more recesses configured to orient the first end of the stackable weight to a corresponding first end of the second stackable weight and configured to prevent rotation of the stackable weight relative to the second stackable weight.

In an aspect, the front surface of the first stackable weight engages with the rear surface of the second stackable weight, and the handle of the first stackable weight is oriented in the same direction as the handle of the second stackable weight.

In an aspect, the one or more projections of the first stackable weight engage the one or more recesses of the second stackable weight when the one or more projections of the first stackable weight and the one or more recesses of the second stackable weight are aligned with one another.

In an aspect, the stackable weight comprises a plurality of projections on the front surface of the body, the plurality of projections configured to engage a corresponding one of a plurality of recesses on the rear surface of the second stackable weight.

In an aspect, the stackable weight comprises a plurality of recesses on the front surface of the body, the plurality of recesses configured to engage a corresponding one of a plurality of projections on a rear surface of the second stackable weight.

In an aspect, a center of gravity of the stackable weight is located in a position relative the second end of the body to orient the second end of the body towards the ground.

In an aspect, the second end of the body is substantially flat such that the stackable weight does not roll when placed on a surface.

In an aspect, the stackable weight has a color that represents the weight of the stackable weight for identification by the user.

In an aspect, the opening is configured to facilitate attachment of the stackable weight to a weight bar.

According to another aspect, a stackable weight comprises a body having a first end, a second end opposite the first end, a front surface, and a rear surface opposite the front surface, a projection extending from the front surface configured to engage a recess on a rear surface of a second stackable weight, and a recess on the front surface configured to engage a projection on the rear surface of the second stackable weight, wherein the projection and the recess are configured to prevent rotation of the stackable weight about an axis when the front surface of the stackable weight engages the rear surface of the second stackable weight, the axis extends in a direction from the stackable weight to the second stackable weight.

In an aspect, a center of gravity of the stackable weight is located in a position relative to the second end of the body to orient the second end of the body towards a ground surface.

The foregoing and other features of the invention are hereinafter described in greater detail with reference to the accompanying drawings.

DETAILED DESCRIPTION

Figure 1:
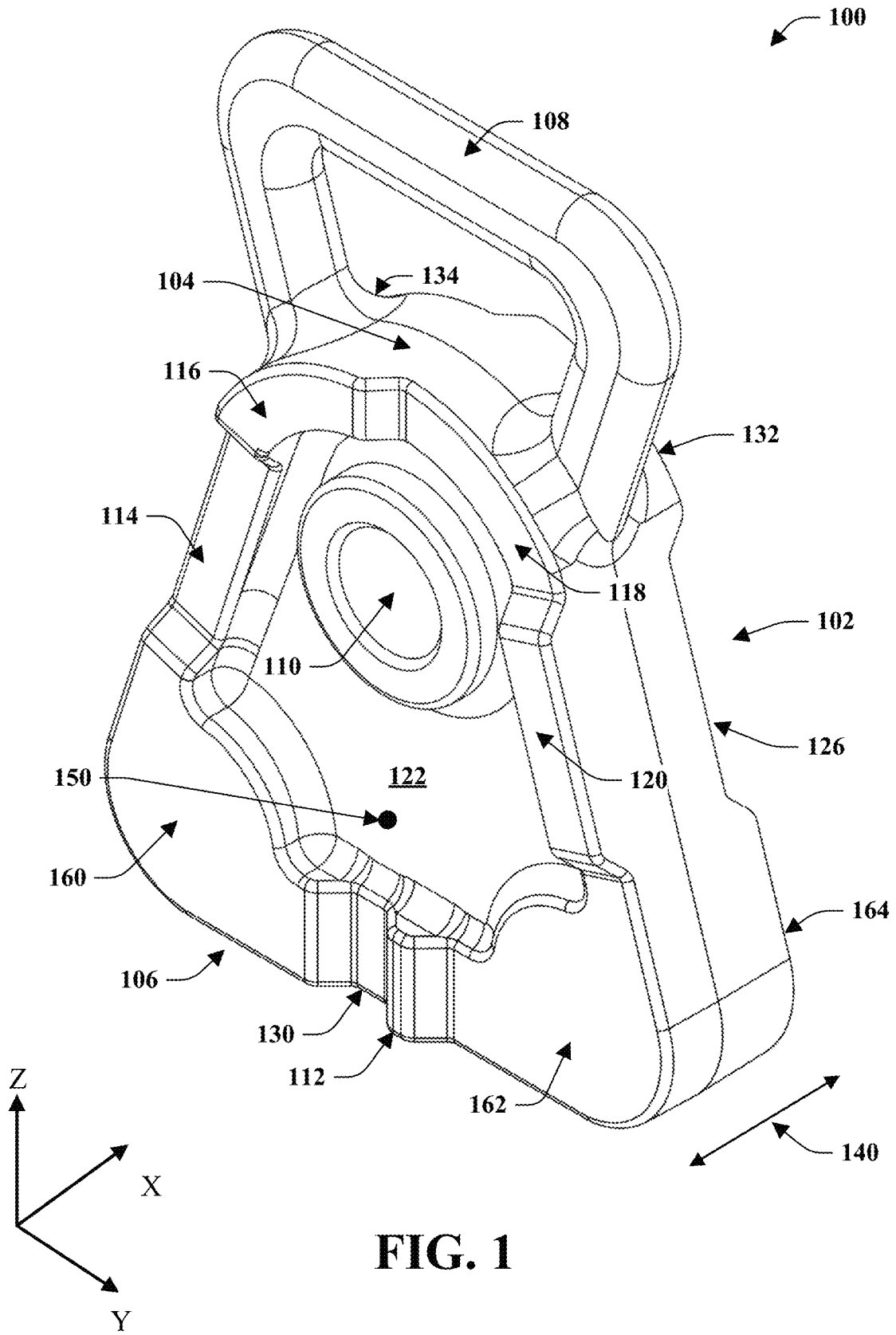
FIG. 1 is a perspective view of an exemplary stackable weight.
Figure 2:
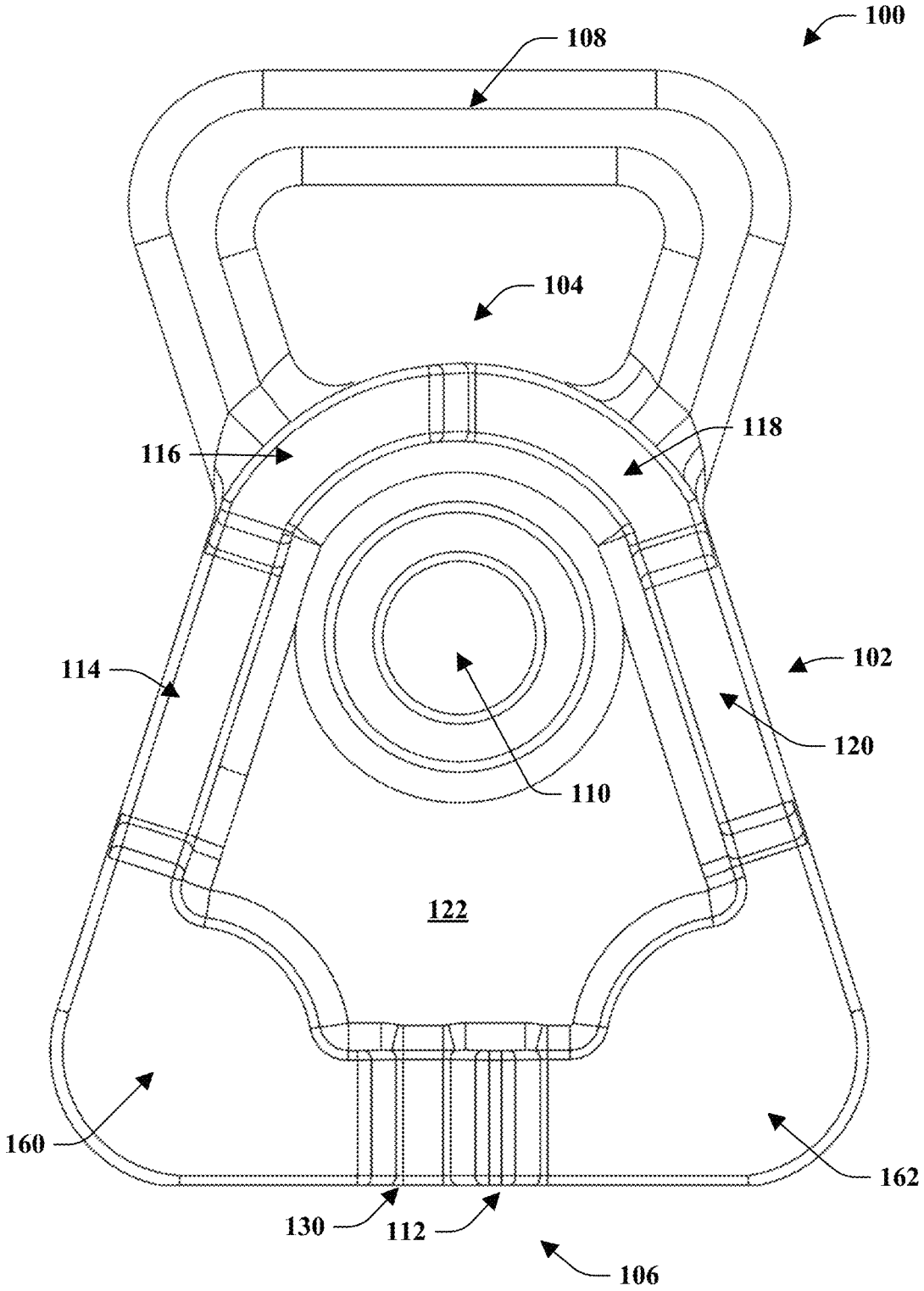
FIG. 2 is a front view of the stackable weight.
Figure 3:
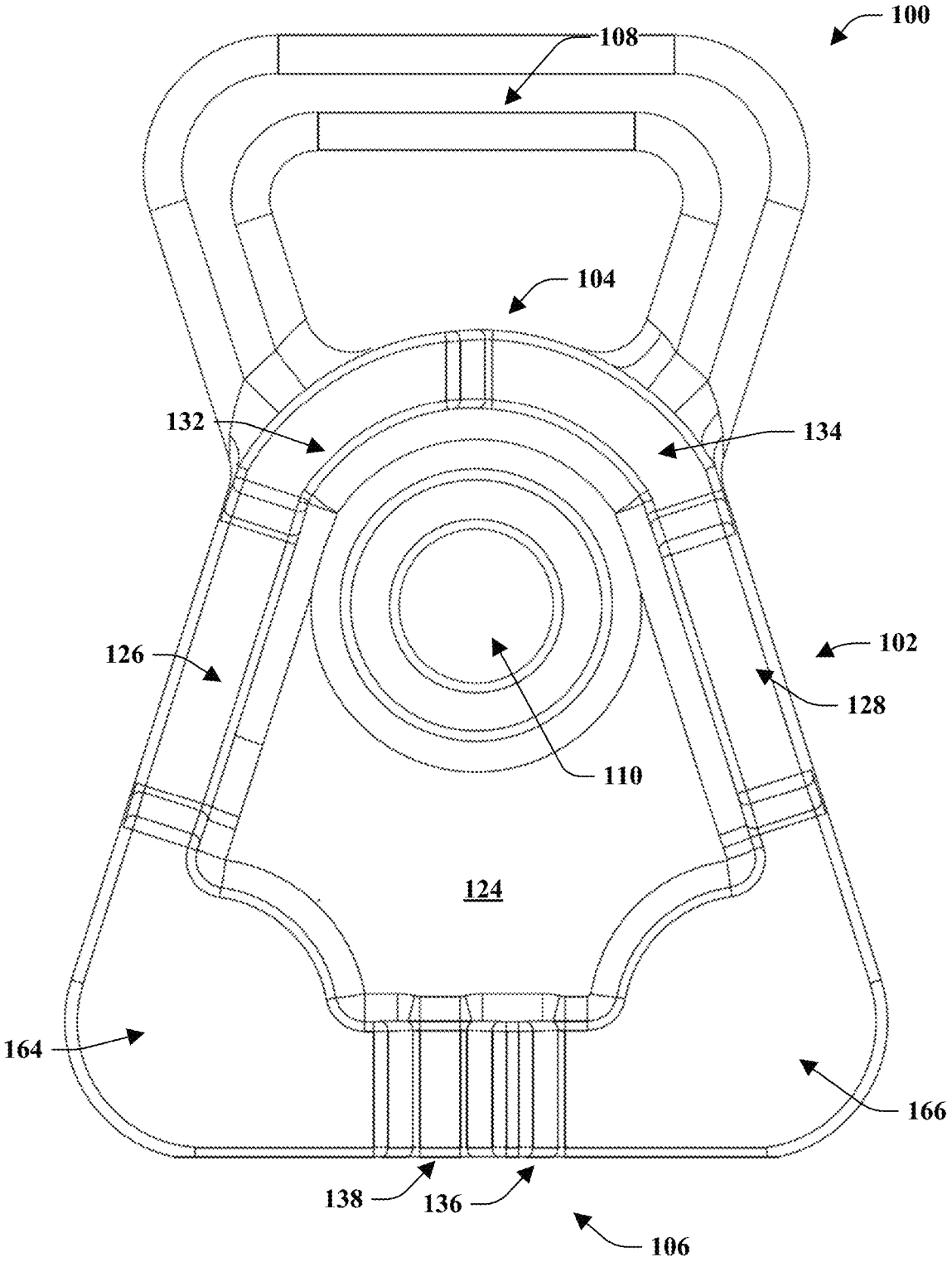
FIG. 3 is a rear view of the stackable weight.
Figure 4:
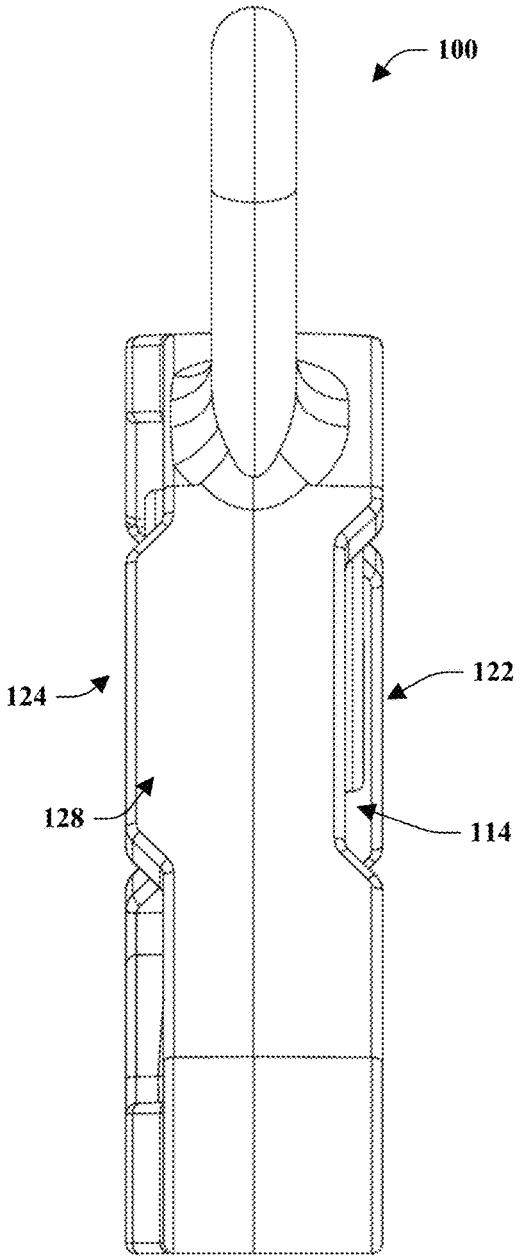
FIG. 4 is a left side view of the stackable weight.
Figure 5:
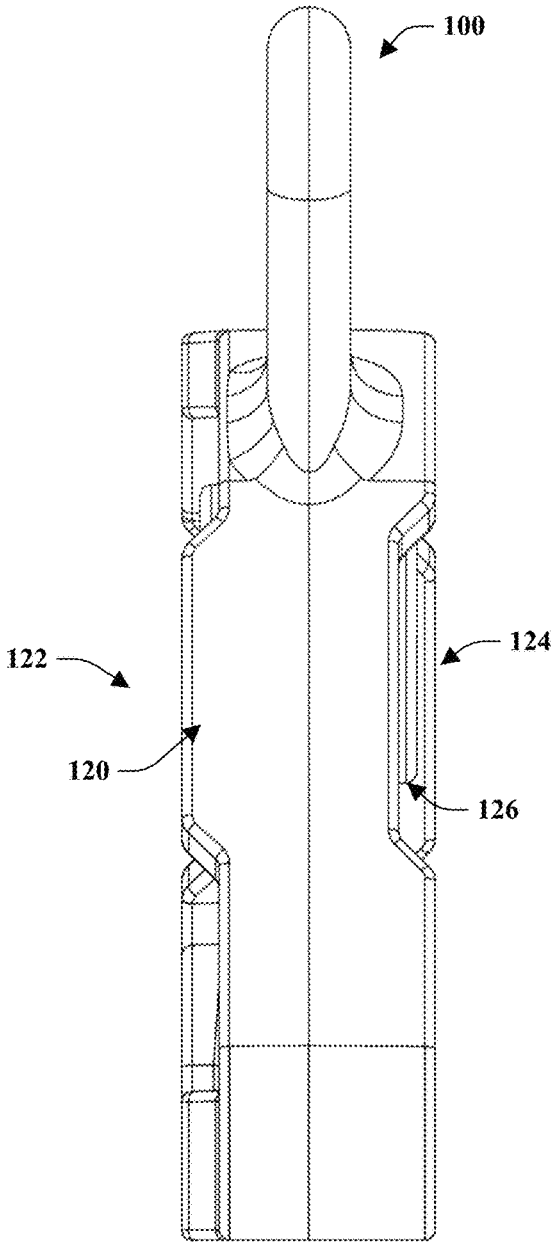
FIG. 5 is a right side view of the stackable weight.
Figure 6:
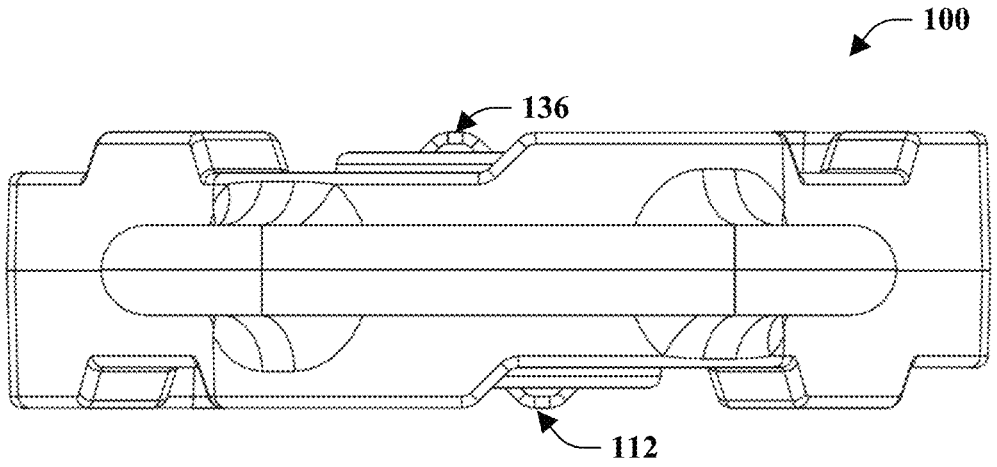
FIG. 6 is a top view of the stackable weight.
Figure 7:
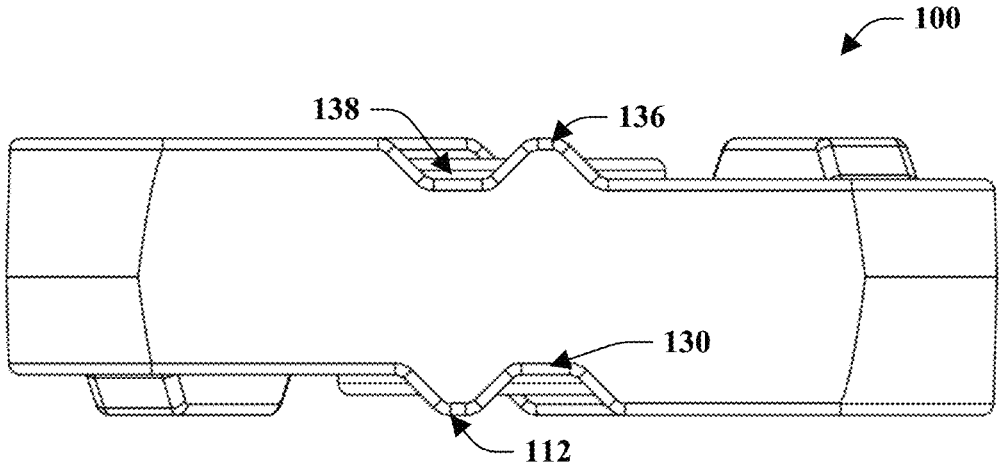
FIG. 7 is a bottom view of the stackable weight.

Typical individual weights used in conjunction with weight bars can be difficult to carry, difficult to attach to weight bars, difficult to pick up off of the floor, and may move around on the weight bar. The present application describes a stackable weight that may be easier to carry and load onto weight bars through the incorporation of a carrying handle and by the compact shape of the weight. The weight may include various features to allow the weight to be stacked against other weights to reduce movement of the weights on the weight bar.

Unless stated otherwise, the term "stackable weight" refers to a lift-able physical object or weight lifting device and will be identified by reference numeral. The term "weight" refers to a unit of measurement regarding an object's mass or heaviness.

Turning now to FIGS. 1-7, a stackable weight is shown generally at reference numeral 100. The stackable weight 100 may have a body 102 with a first end 104 and a second end 106. The stackable weight 100 may also include a handle 108 attached to the stackable weight 100 at the first end 104. An opening 110 may extend between a front face 122 and a rear face 124 of the body 102 for receiving an end of a weight bar. The stackable weight 100 may also include at least one feature 112 for engaging like features of a second stackable weight. For example, one weight may include a projection 112 and another weight may include a corresponding recess for engaging with the projection 112. The stackable weight 100 may include other features 114, 116, 118, 120, 126, 128, 130, 132, 134, 160, 162, 164, and 166 for similar stacking purposes. For example, the features 112, 116, 120, 128, 132, 136, 160, and 164 may be projections and features 114, 118, 126, 130, 134, 138, 162, and 166 may be corresponding recesses.

The projections on the front face may engage recesses on the rear face of an adjacent weight. Similarly, the recesses on the front face may engage projections on the rear face of the adjacent weight. For example, the stackable weight 100 may include the projection 112 and the recess 130 located at the front face 122 and at the second end 106 of the stackable weight 100. The stackable weight may further include the corresponding projection 136 and recess 138 located at the rear face 124 and at the second end 106 of the stackable weight 100. The projection 120 may extend along a side of the front face 122, and the corresponding recess 126 may extend along the same side of the rear face 124 of the stackable weight 100. Similarly, the recess 114 may extend along a side of the front face 122, and the corresponding projection 128 may extend along the same side of the rear face 124 of the stackable weight 100. The projection 116 and the recess 118 may be located proximate one another on the front face 122 and the first end 104 of the stackable weight 100. Corresponding projection 132 and recess 134 may be located proximate one another on the rear face 124 and the first end 104 of the stackable weight 100. The projection 160 may be located at the second end 106 and on the front face 122, proximate a bottom corner of the stackable weight 100. The recess 162 may be located at the second end 106 and on the front face 122, proximate an opposite bottom corner of the stackable weight 100. Corresponding projection 164 and recess 166 may be located at the second end 106 and on the rear face 124, proximate opposite bottom corners of the stackable weight 100.

The stackable weight 100 may be attached to a weight bar by inserting an end of a weight bar into the opening 110 of the stackable weight 100. The stackable weight 100 may then be slid onto the weight bar and may be secured to the weight bar using a device (e.g., a securable collar, etc.). The stackable weights 100 are usually attached to weight bars in pairs so that each side of the weight bar has a substantially equal weight and so the weight bar is properly balanced for use. Any number of individual weights or stackable weights may be installed on a weight bar to achieve the desired weight.

The stackable weight 100 may be manufactured to any suitable size, weight, or shape. By way of example, the stackable weight 100 may be fifty pounds, seventy-five pounds, or one hundred pounds, or any other suitable weight. The weight of the stackable weight 100 may be varied by increasing or decreasing the width 140 of the stackable weight 100. In another example, the weight of the stackable weight 100 may be varied by increasing or decreasing the overall dimensions of the stackable weight 100. In yet another example, the weight of the stackable weight 100 may be varied by manufacturing the stackable weight 100 with material of varying compositions, density, mass, etc.

In an embodiment, the stackable weight 100 may be manufactured in a certain color to identify the weight of the stackable weight 100. For example, a fifty pound weight may be represented by a first color, such as the color blue, a seventy-five pound weight may be represented by a second color, such as the color brown, and a one hundred pound weight may be represented by a third color, such as the color purple. In other embodiments, the weight may be indicated by a writing on the stackable weight 100 along with or in lieu of a color identifier of the stackable weight 100. The stackable weight 100 may be formed of any suitable material. For instance, the stackable weight 100 may be formed from materials such as steel, cast iron, rubber, urethane, concrete, plastics, or the like. The stackable weight 100 may also be manufactured as solid construction, hollow construction, or any combination thereof to achieve desired characteristics.

The center of gravity of the stackable weight 100 may be located at a location 150. The stackable weight 100, having a center of gravity at the location 150 may ensure that the handle 108 of the stackable weight 100 remains facing upward by biasing the second end 106 toward the ground. The location 150 of the center of gravity may be in a position relative the second end 106 of the stackable weight 100. The center of gravity may ensure that the second end 106 of the stackable weight 100 faces downward toward the ground when attached to a weight bar (i.e., and the handle 108 faces upward). It should be appreciated that the center of gravity may be at location 150 or any other suitable location to ensure that the stackable weight 100 is oriented in an upright position with the handle 108 facing upward and the second end 106 facing the ground.

The center of gravity of the stackable weight 100 may also be configured such that the stackable weight rotates or swings slightly when installed on a barbell and while the barbell is in use. In other words, as a user lifts the barbell installed with stackable weights 100, the stackable weights 100 may rotate or swing axially about/around the center axis of the barbell. The center axis may extend through the passage 110 from the front face 122 to the rear face 124 and may be represented by the X-axis illustrated by the legend of FIG. 1. It should be appreciated that the swinging motion or rotation may activate stabilizing muscle groups for a user in a manner similar to that of training bands of chains. It should be appreciated that to achieve a suitable swinging motion or rotation, the center of gravity may be at a location 150 or any other suitable location.

In an example, the stackable weight 100 may have a substantially flat second end 106. The flat second end 106 may allow the stackable weight 100 to rest on a surface (e.g., the ground) without rolling or rotating. This may ensure that the stackable weight 100 does not move or roll when installed onto a weight bar. One skilled in the art or familiar with weight lifting will appreciated the numerous benefits associated with a weight bar that does not roll on the ground. For instance, it can cause a safety hazard when heavy weights are allowed to roll along an exercise floor. It should also be appreciated that the center of gravity at location 150 may ensure that the flat second end 106 is always oriented toward the ground (e.g., after lifting the weight bar and placing onto ground).

Turning to FIGS. 8-11, three stackable weights 200, 200', 200" of similar weight and size are shown stacked relative to one another. By way of example, the stack of weights 200, 200', 200" may be inserted onto a weight bar as a group. Each stackable weight 200, 200', 200" may weigh a first weight, such as fifty pounds, giving the whole group a total weight of one hundred fifty pounds. In a typical application, the stackable weights 200, 200', 200" will be attached to a weight bar with identical weights on each side of the weight bar (i.e., for weight balancing). For example, the group of three stackable weights 200, 200', 200" will be attached to one side of the weight bar and a second group of three stackable weights of the same weight will be attached to the other side of the weight bar, for a total of six stackable weights (i.e., three stackable weights on each side) resulting in 300 pounds of stackable weights plus the weight of the weight bar.

Figure 8:
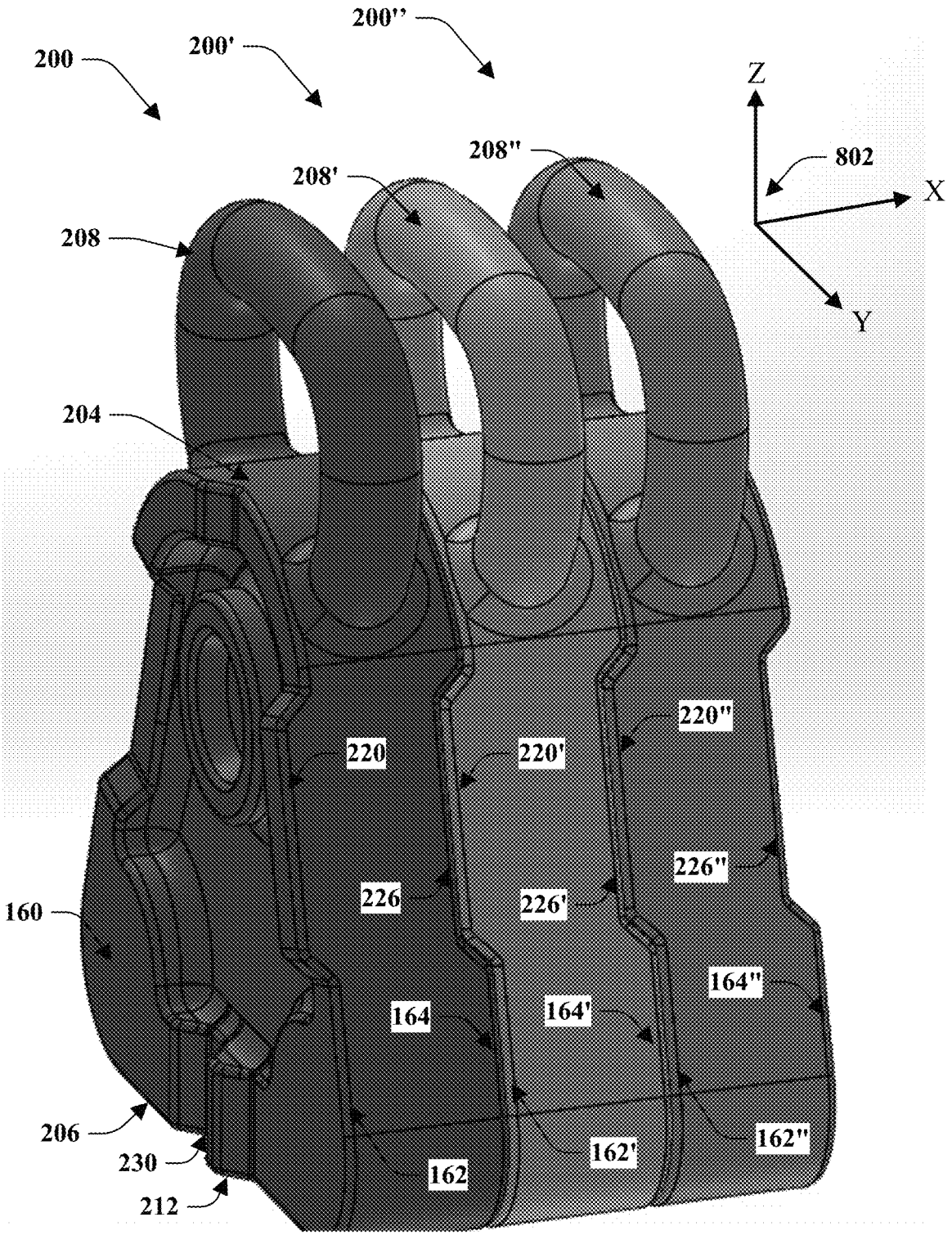
FIG. 8 is a perspective view of an exemplary system of three stackable weights, of similar weight, stacked together.
Figure 9:
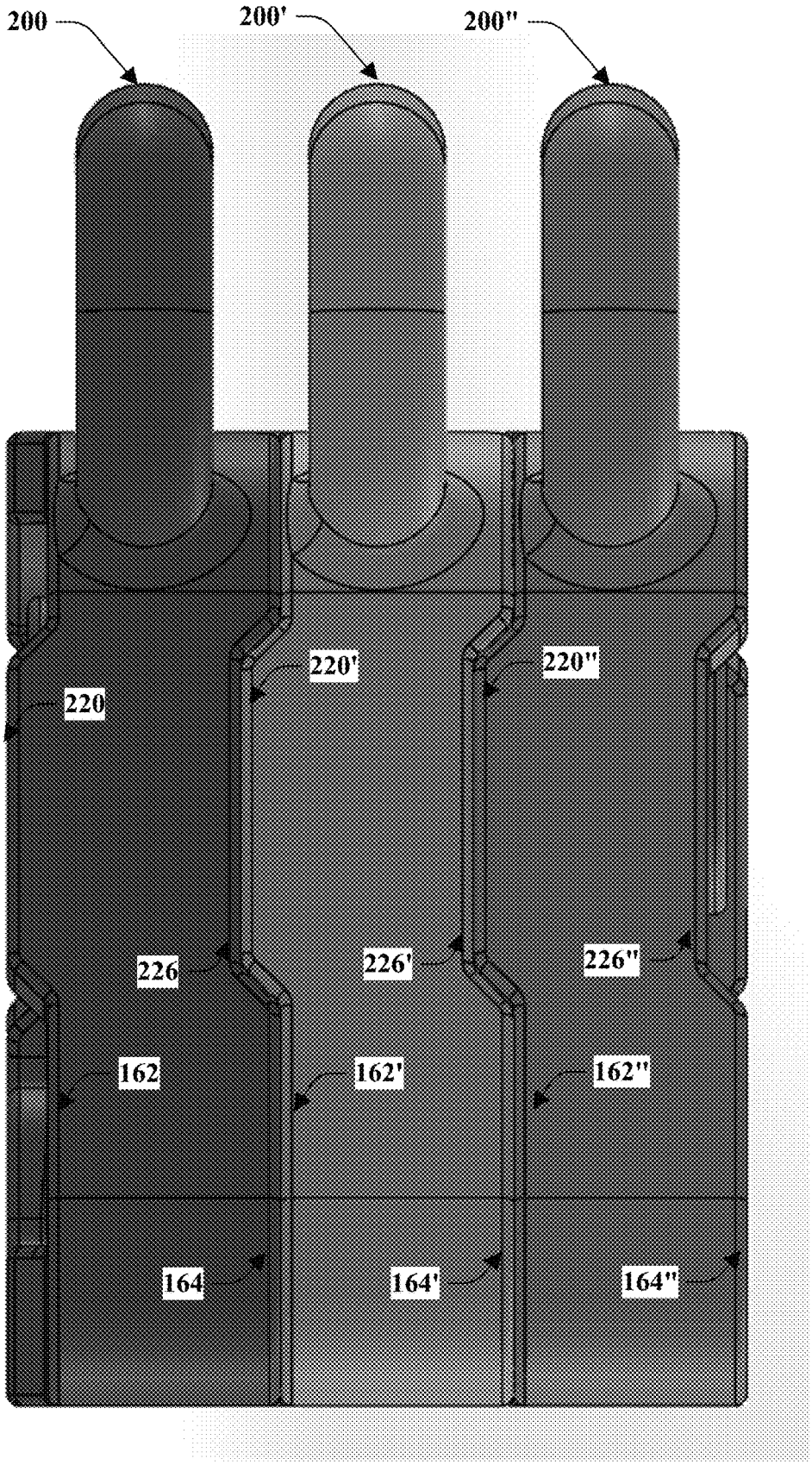
FIG. 9 is a side view of the system of FIG. 8.

As shown in FIGS. 8 and 9, the various features of the stackable weights 200, 200', 200" engage in a manner to limit movement of the stackable weights 200, 200', 200" in relation to one another. The recess 226 of the stackable weight 200 may engage with the projection 220' of the stackable weight 200', amongst others, and the recess 226' of the stackable weight 200' may engage with the projection 220" of the stackable weight 200", amongst others, to limit movement between the three stackable weights 200, 200', 200".

According to an example, the various features of the stackable weights 200, 200', 200" engage in a manner to limit movement or rotation along at least one axis. For instance, as shown in FIG. 8, there may be an X-axis, a Y-axis, and a Z-axis. The X-axis may extend in a direction from the stackable weight 200 to the stackable weight 200" as illustrated with the axis legend 802. The Y-axis may extend in a direction from a left side of the stackable weight 200 to the right side of the stackable weight 200 as illustrated with the axis legend 802. The Z-axis may extend in a direction from the first end 204 to the second end 206 of the stackable weight 200, as illustrated with the axis legend 802.

The various features of stackable weights 200, 200', 200" may limit, reduce, or restrict movement along the Y-axis and/or the Z-axis. Movement along the X-axis may be un-restricted or uninhibited at least to allow for installation and removal of the stackable weights 200, 200', 200" onto a weight bar. Yet, in other examples, movement may be limited, reduced, or restricted along the X-axis direction as well using any suitable means. For instance, the stackable weights 200, 200', 200" may include a locking feature to limit movement in the X-direction. In other examples, a locking collar may be placed on the outside of a weight bar to restrict movement of the stackable weights 200, 200', 200" in the X-direction.

In other examples, the various features of the stackable weights 200, 200', 200" may restrict, limit, or reduce rotation about at least one axis. For instance, rotation along, about, or around the X-axis may be restricted, limited, or reduced by various features of the stackable weights 200, 200', 200". In this manner, the handles 208, 208', and 208" may be aligned and may stay aligned as the stackable weights are lifted or moved. Those skilled in the art or those familiar with weight lifting will appreciate the benefits associated with limited rotation about the X-axis. For instance, limiting rotation around the X-axis may limit or reduce the total movement of the stackable weights 200, 200', 200" with respect to one another. Limited movement between the stackable weights 200, 200', 200" may provide an increased overall experience for the weight lifter. It may also improve stacking capabilities of the weights in regard to storage or transportation.

The stackable weights 200, 200', 200" may include projections and recesses similar to that of stackable weight 100. Therefore, it should be appreciated that the various features may include at least projections of the stackable weights 200, 200', 200" that are similar to projections 112, 116, 120, 128, 132, 136, 160, and 164 of stackable weight 100. The various features may also include recesses of the stackable weights 200, 200', 200" similar to the recesses 114, 118, 126, 130, 134, 138, 162, and 166 of the stackable weight 100. For instance, as illustrated in FIG. 8, the stackable weights 200, 200', 200" may include the projections 220, 200', 220", 164, 164', and 164"; and the recesses 226, 226', 226", 162, 162', and 162".

Figure 10:
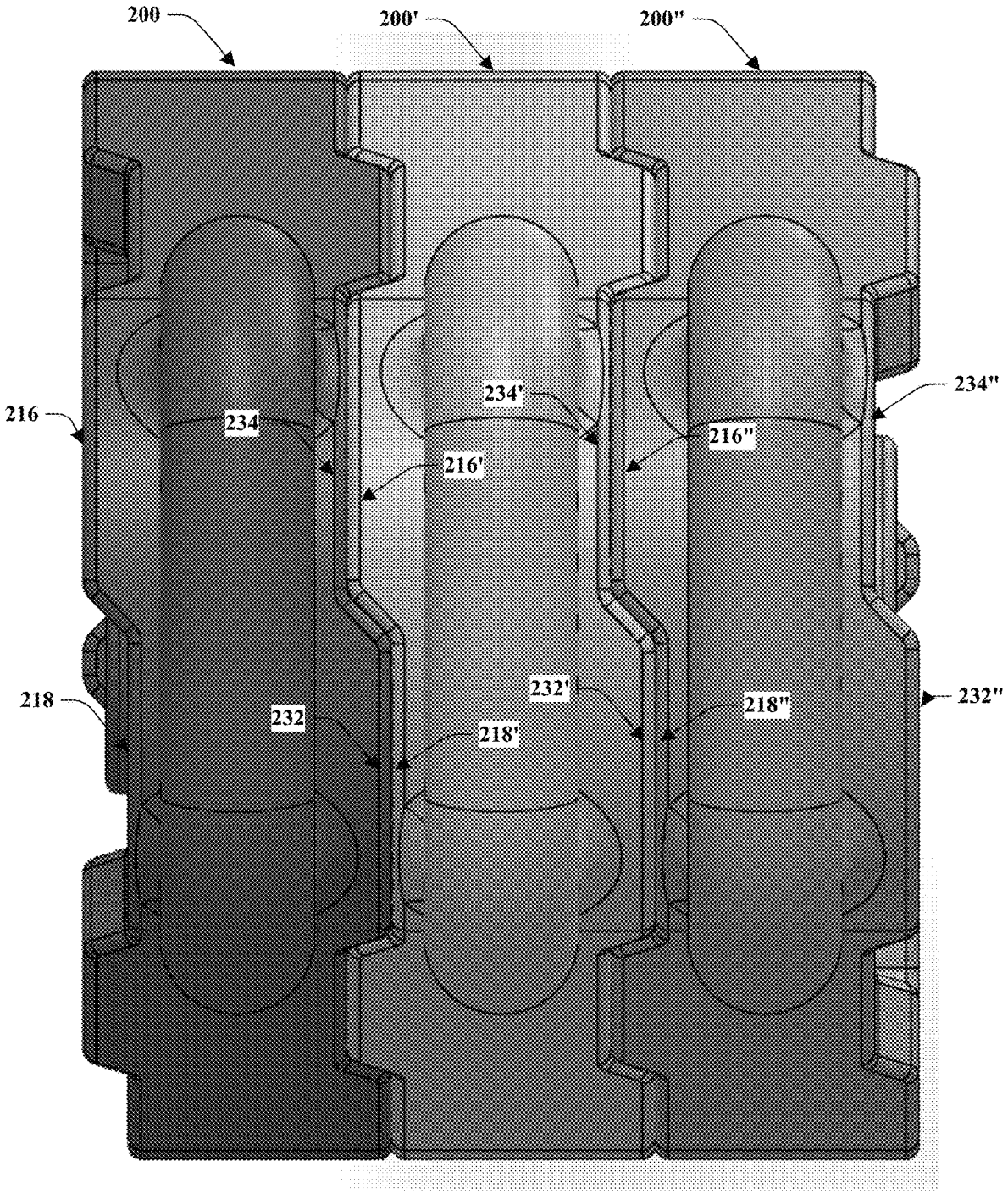
FIG. 10 is a top view of the system of FIG. 8.

FIG. 10 shows the stackable weights 200, 200', 200" from a top view to further show how the stackable weights engage one another when stacked against each other. For example, the recess 234 of stackable weight 200 may engage with the projection 216' of the stackable weight 200' and the recess 234' of the stackable weight 200' may engage with the projection 216" of the stackable weight 200" to limit movement between the three stackable weights 200, 200', 200". According to the example, the projection 232 of the stackable weight 200 may engage with the recess 218' of the stackable weight 200' and the projection 232' of the stackable weight 200' may engage with the recess 218" of the stackable weight 200" to limit movement between the three stackable weights 200, 200', 200". In either example, it should be appreciated that movement may be limited along the Y-axis and/or Z-axis and rotation may be limited around the X-axis when the stackable weights 200, 200', 200" are placed against one another.

Figure 11:
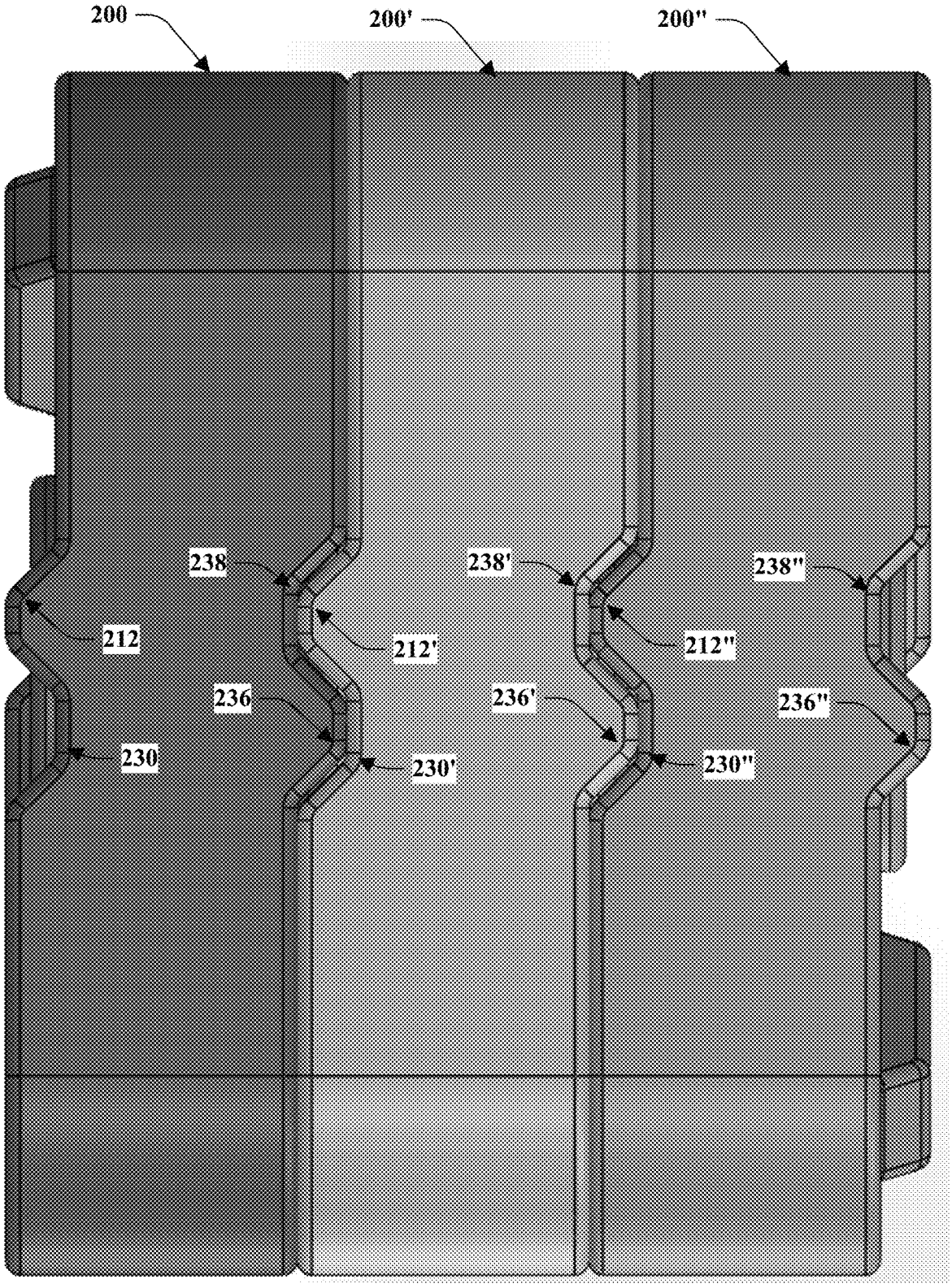
FIG. 11 is a bottom view of the system FIG. 8.

FIG. 11 shows the stackable weights 200, 200', 200" from a bottom view to further show how the stackable weights engage one another when stacked against each other. For example, the recess 238 of the stackable weight 200 may engage with the projection 212' of the stackable weight 200' and the recess 238' of the stackable weight 200' may engage with the projection 212" of the stackable weight 200" to limit movement between the three stackable weights 200, 200', 200". According to the example, the projection 236 of the stackable weight 200 may engage with the recess 230' of the stackable weight 200' and the projection 236' of the stackable weight 200' may engage with the recess 230" of the stackable weight 200" to limit movement between the three stackable weights 200, 200', 200".

Figure 12:
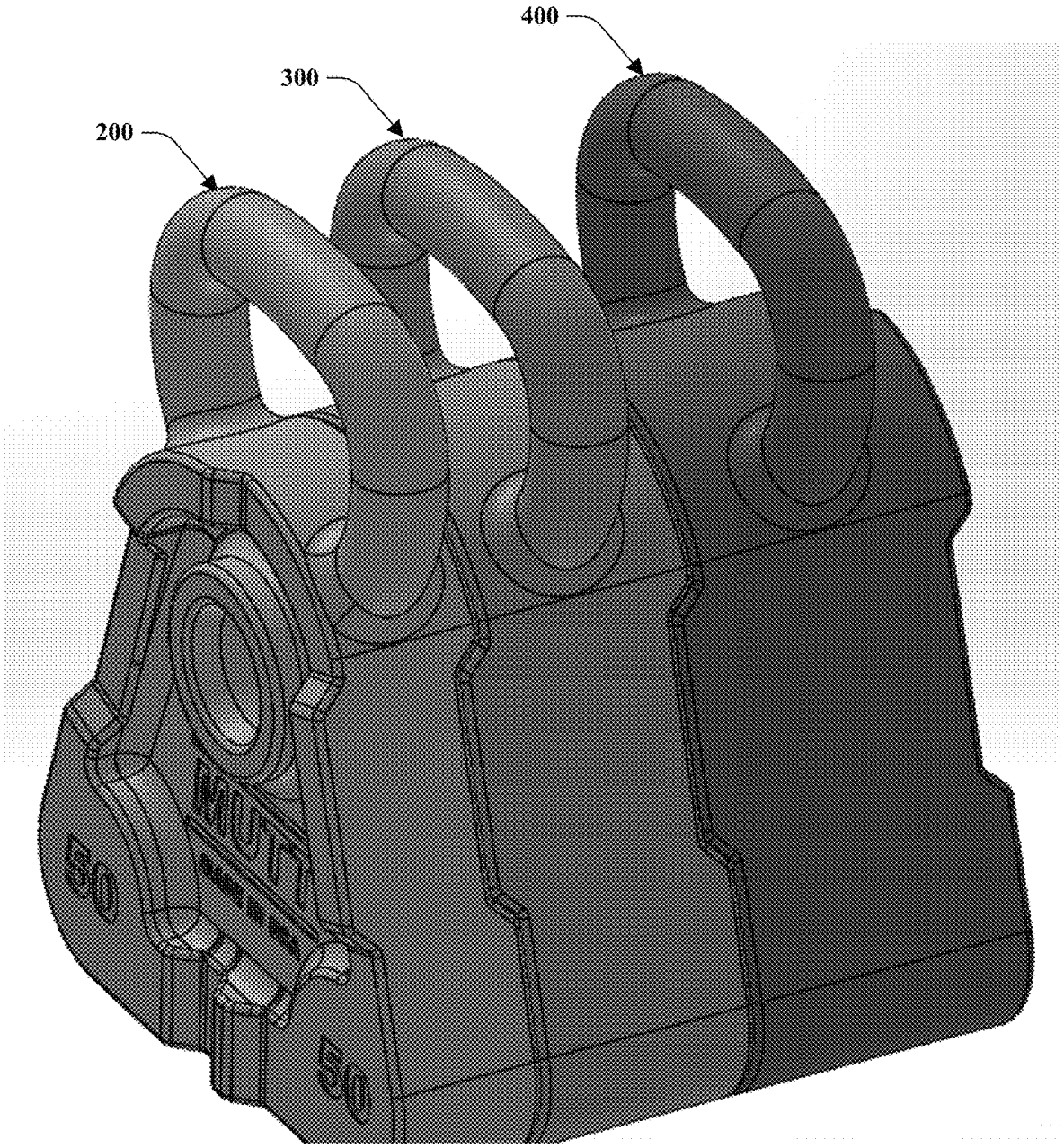
FIG. 12 is perspective view of an exemplary system of three stackable weights, of different weight, stacked together.
Figure 13:
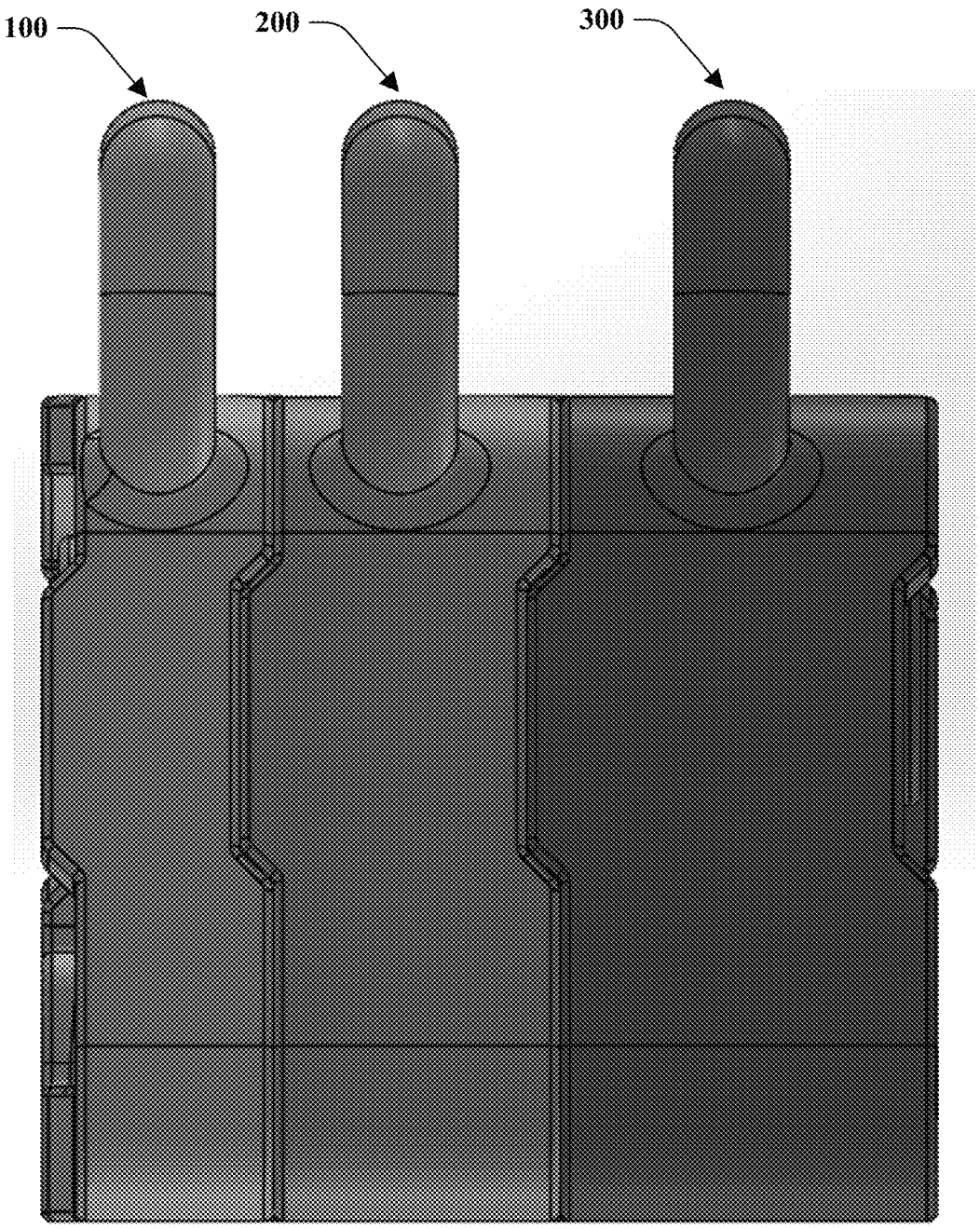
FIG. 13 is a side view of the system of FIG. 12.

Turning to FIGS. 12-13, three stackable weights 200, 300, 400 of different weights are shown stacked to one another. By way of example, the stackable weight 200 may be 50 pounds, the stackable weight 300 may be 75 pounds, and the stackable weight 400 may be 100 pounds resulting in a total weight of 225 pounds. One will notice that, even though the stackable weights 200, 300, 400 have different widths, they have the same overall dimensions of front and rear surfaces, allowing stackable weights of different weights to be stacked against one another in a manner similarly shown in FIGS. 8-11. In this particular example, a color blue may represent the 50 pound stackable weight 200, the color brown may represent the 75 pound stackable weight 300, and the color purple may represent the 100 pound stackable weight 400.

Although certain embodiments have been shown and described, it is understood that equivalents and modifications falling within the scope of the appended claims will occur to others who are skilled in the art upon the reading and understanding of this specification.

What is claimed is:

1. A stackable weight comprising:

a body having a top surface, a bottom surface, a front surface, and a rear surface, the top surface is rounded and perpendicular to planes of the front and rear surfaces;

a handle extending from the top surface of the body in a direction parallel to the planes of the front and rear surfaces, wherein the handle is configured to allow a user's hand to grasp the handle;

an opening in the body, wherein the opening extends from the front surface of the body to the rear surface of the body; and one or more projections extending from the front surface configured to engage one or more corresponding recesses on a rear surface of a second stackable weight.

2. The stackable weight of claim 1, wherein the front surface of the stackable weight engages with the rear surface of the second stackable weight, and the handle of the stackable weight is oriented in the same direction as a handle of the second stackable weight.

3. The stackable weight of claim 2, wherein the one or more projections of the stackable weight engage the one or more recesses of the second stackable weight when the one or more projections of the stackable weight and the one or more recesses of the second stackable weight are aligned with one another.

4. The stackable weight of claim 2, wherein the one or more projections comprise a plurality of projections on the front surface of the body, the plurality of projections configured to engage a corresponding one of a plurality of recesses on the rear surface of the second stackable weight.

5. The stackable weight of claim 4, wherein the stackable weight comprises a plurality of recesses on the front surface of the body, the plurality of recesses configured to engage a corresponding one of a plurality of projections on a rear surface of the second stackable weight.

6. The stackable weight of claim 1, wherein a center of gravity of the stackable weight is located in a position relative to the bottom surface of the body to orient the bottom surface of the body towards a ground surface.

7. The stackable weight of claim 1, wherein the bottom surface of the body is substantially flat such that the stackable weight does not roll when placed on a surface.

8. The stackable weight of claim 1, wherein the stackable weight has a color that represents the weight of the stackable weight for identification by the user.

9. The stackable weight of claim 1, wherein the opening is configured to facilitate attachment of the stackable weight to a weight bar.

10. A weight lifting system, comprising:

a first stackable weight and a second stackable weight, each configured to attach to a weight bar, and each of the first and the second stackable weights comprising:

a body having a top surface, a bottom surface, a front surface, and a rear surface, the top surface is rounded and perpendicular to planes of the front and rear surfaces;

a handle extending from the top surface of the body in a direction parallel to the planes of the front and rear surfaces, wherein the handle is configured to allow a user's hand to grasp the handle;

an opening in the body, wherein the opening extends from the front surface of the body to the rear surface of the body; and one or more projections extending from the front surface configured to engage one or more recesses on a rear surface of a separate corresponding stackable weight.

11. The weight lifting system of claim 10, wherein the front surface of the first stackable weight engages with the rear surface of the second stackable weight, and the handle of the first stackable weight is oriented in the same direction as the handle of the second stackable weight.

12. The weight lifting system of claim 11, wherein the one or more projections of the first stackable weight engage the one or more recesses of the second stackable weight when the one or more projections of the first stackable weight and the one or more recesses of the second stackable weight are aligned with one another.

13. The weight lifting system of claim 11, wherein the one or more projections comprise a plurality of projections on the front surface of the body, the plurality of projections configured to engage a corresponding one of a plurality of recesses on the rear surface of the second stackable weight.

14. The weight lifting system of claim 13, wherein the first stackable weight comprises a plurality of recesses on the front surface of the body, the plurality of recesses configured to engage a corresponding one of a plurality of projections on a rear surface of the second stackable weight.

15. The weight lifting system of claim 10, wherein a center of gravity of each of the first and the second stackable weights is located in a position relative to the bottom surface of the body to orient the bottom of the body towards the ground.

16. The weight lifting system of claim 10, wherein for each of the first and the second stackable weights, the bottom surface of the body is substantially flat such that the first and the second stackable weights not roll when placed on a surface.

17. The weight lifting system of claim 10, wherein each of the first and the second stackable weights has a color that represents a weight of each of the stackable weights for identification by the user.

18. The weight lifting system of claim 10, wherein the opening of each of the first and the second stackable weights is configured to facilitate attachment of each of the stackable weights to a weight bar.

19. A stackable weight comprising:

a body having a top surface, a bottom surface, a front surface, and a rear surface opposite the front surface, the top surface is rounded and perpendicular to planes of the front and rear surfaces;

a projection extending from the front surface configured to engage a recess on a rear surface of a second stackable weight; and a recess on the front surface configured to engage a projection on the rear surface of the second stackable weight, wherein the projection and the recess are configured to prevent rotation of the stackable weight about an axis when the front surface of the stackable weight engages the rear surface of the second stackable weight, the axis extends in a direction from the stackable weight to the second stackable weight.

20. The stackable weight of claim 19, wherein a center of gravity of the stackable weight is located in a position between the bottom surface of the body and the opening to orient the bottom of the body towards a ground surface.

* * * * *